US009412548B2

(12) United States Patent
Maloney et al.

(10) Patent No.: US 9,412,548 B2
(45) Date of Patent: Aug. 9, 2016

(54) CIRCUIT BREAKERS WITH HANDLE BEARING SLEEVES

(71) Applicant: Eaton Corporation, Cleveland, OH (US)

(72) Inventors: James Gerard Maloney, Industry, PA (US); Daniel Quentin Gates, Rockaway, NJ (US)

(73) Assignee: Eaton Corporation, Cleveland, OH (US)

( * ) Notice: Subject to any disclaimer, the term of this patent is extended or adjusted under 35 U.S.C. 154(b) by 61 days.

(21) Appl. No.: 14/458,954

(22) Filed: Aug. 13, 2014

(65) Prior Publication Data

US 2016/0049274 A1 Feb. 18, 2016

(51) Int. Cl.
*H01H 71/02* (2006.01)
*H01H 71/24* (2006.01)

(52) U.S. Cl.
CPC ..... *H01H 71/025* (2013.01); *H01H 71/24* (2013.01); *H01H 2205/002* (2013.01)

(58) Field of Classification Search
CPC ..... H01H 21/22; H01H 71/025; H01H 71/24; H01H 2205/002; H01H 21/10; H01H 71/521; H01H 71/522; H01H 71/523; H01H 71/524; H01H 71/525; H01H 71/526; H01H 71/527; H01H 71/528; H01H 71/529
See application file for complete search history.

(56) References Cited

U.S. PATENT DOCUMENTS

| | | | | |
|---|---|---|---|---|
| 2,322,646 | A | 6/1943 | Johnson | |
| 2,618,716 | A | 11/1952 | Boller | |
| 2,701,284 | A | 2/1955 | Harold | |
| 3,081,386 | A | 3/1963 | Pastene | |
| 3,110,786 | A * | 11/1963 | Gelzheiser | H01H 71/0221 335/37 |
| 3,171,921 | A | 3/1965 | Woods | |
| 3,240,902 | A * | 3/1966 | Gelzheiser | H01H 71/1018 200/50.4 |
| 3,286,071 | A * | 11/1966 | Gelzheiser | H01H 71/1018 200/337 |
| 3,950,714 | A | 4/1976 | Mrenna | |
| 4,276,457 | A * | 6/1981 | Myers | H01H 71/524 200/401 |
| 4,904,969 | A | 2/1990 | Bagalini | |
| 5,131,504 | A | 7/1992 | Yoo et al. | |
| 5,196,815 | A | 3/1993 | Chien | |
| 5,675,303 | A | 10/1997 | Kelaita | |
| 5,844,188 | A | 12/1998 | Cella | |
| 5,929,405 | A | 7/1999 | Wehrli | |
| 6,087,914 | A | 7/2000 | Kralik | |
| 6,714,108 | B1 | 3/2004 | Simms | |
| 6,759,931 | B1 | 7/2004 | Lias | |
| 6,894,594 | B2 | 5/2005 | Fello | |
| 8,222,983 | B2 | 7/2012 | Zhou et al. | |
| 2004/0150497 | A1 | 8/2004 | Lias | |
| 2013/0076461 | A1 | 3/2013 | Maloney | |
| 2013/0146428 | A1 * | 6/2013 | Maloney | H01H 71/0271 200/17 R |
| 2016/0049263 | A1 | 2/2016 | Maloney et al. | |

* cited by examiner

*Primary Examiner* — Mohamad Musleh
(74) *Attorney, Agent, or Firm* — Myers Bigel & Sibley, P.A.

(57) ABSTRACT

Circuit breakers with handles having a handle bearing sleeve that contacts an upper end portion of a moving arm and allows the arm to rotate to "OFF", "ON" and "TRIP" positions, typically with about 90 degrees of rotation.

20 Claims, 11 Drawing Sheets

CIRCUIT BREAKERS WITH HANDLE BEARING SLEEVES

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. As long as the stationary and movable contacts are in physical contact, current passes from the stationary contact to the movable contact and out of the circuit breaker to down-line electrical devices.

In the event of an overcurrent condition (e.g., a short circuit), extremely high electromagnetic forces can be generated. The electromagnetic forces repel the movable contact away from the stationary contact. Because the movable contact is fixedly attached to the rotating arm, the arm pivots and physically separates the stationary and movable contacts, thus tripping the circuit. Upon separation of the contacts and blowing open the circuit, an arcing condition occurs. The breaker's trip unit will trip the breaker which will cause the contacts to separate.

In the past, as shown in FIG. 1, circuit breakers have used handles 15 that cooperate with a respective moving arm 25. The handle 15 pivots and the arm 25 rotates between "OFF", "ON" and "TRIP" positions. During endurance testing per UL 489, the arm 25 rapidly repetitively moves through its operative positions. The moving arm 25 may wear into the handle or the handle may undesirably degrade, e.g., exhibit blistering due to one or more of heat, friction and/or forces from the arm.

SUMMARY OF EMBODIMENTS OF THE INVENTION

Embodiments of the present invention are directed to circuit breakers with new and inventive handle bearing configurations.

Embodiments of the invention are directed to circuit breakers with a housing and a pivotable handle held by the housing. The handle has a handle bearing segment, typically configured as an inwardly extending protrusion. The circuit breaker also has an arm held in the housing in communication with the handle, the arm having opposing first and second end portions. The first end portion of the arm is held in an arm receiving channel in the handle and the second end portion has an electrical movable contact. The circuit breaker also has a stationary electrical contact held in the housing so as to selectively electrically engage the movable contact. The circuit breaker also has a sleeve held on the handle bearing segment, typically the protrusion, so that the first end portion of the arm moves against the sleeve as the arm and handle move between ON and OFF positions in the housing.

The circuit breaker can also have a TRIP operative position. The first end portion of the arm can move against the sleeve as the arm and handle move between the ON and OFF positions and the TRIP position.

The handle bearing segment can comprise a protrusion that can have an elongate shape. The sleeve can have a shape that conforms to the protrusion shape and the sleeve can provide the only contact between the arm and the handle.

With the circuit breaker oriented with the handle extending upward, the first end portion of the arm can move back and forth under the sleeve while in continuous abutting contact with the sleeve.

The handle bearing segment and sleeve can have sides with flat outer surfaces that merge into respective curved lower ends.

With the circuit breaker oriented with the handle extending upward, the sleeve and handle bearing segment can be below and laterally offset from the pivot attachment centerline of the handle.

The first end portion of the arm can have a curvilinear channel that holds the sleeve and allows the handle bearing segment (e.g., protrusion) and sleeve to rock back and forth in the curvilinear channel so that one side of the sleeve contacts a first end of the curvilinear channel in the ON position and a second opposing side of the sleeve contacts a second end of the curvilinear channel in the OFF position.

With the circuit breaker oriented with the handle extending upward, the first end portion of the arm has can have an upwardly facing channel that holds the sleeve and handle bearing segment and the upwardly facing channel can have an arcuate medial segment between planar end segments.

The handle bearing segment (e.g., protrusion) and sleeve can extend across the arm receiving channel.

With the circuit breaker oriented with the handle extending upward, the arm can have an elongate concave shape with the upper end portion having a tip end. The arm receiving channel can extend across an entire bottom portion of the handle and can have an open end portion that allows the tip end of the arm to retract and extend therefrom.

The sleeve can be metal with a thickness of between about 0.002 to about 0.010 inches (or greater) and can have a "V" like shape with the sides tapering inward to a rounded end.

The sleeve can have a thickness of between about 0.003 inches to about 0.005 inches.

The sides of the sleeve can have a height of between about 0.117 to about 0.137 inches.

Other embodiments are directed to handle bearing assemblies for a circuit breaker. The assemblies include a pivotable handle for a circuit breaker configured to rotate between ON and OFF positions. The handle has a lower portion with an arm receiving channel and at least one protrusion with a sleeve covering the protrusion. The sleeve and protrusion extend across the arm receiving channel. The sleeve is configured to contact an arm providing a movable contact for the circuit breaker.

With the handle extending upward, the arm receiving channel can extend across an entire bottom portion of the handle and can have an open tip end configured to allow a tip end of the arm to retract and extend therefrom.

The sleeve can be metal with a thickness of between about 0.002 to about 0.010 inches. The sleeve can have a "V" like shape with the sides tapering inward to a rounded end.

The sleeve can have a thickness of between about 0.003-0.005 inches.

The sides of the sleeve can have a height of between about 0.117 to about 0.137 inches.

The protrusion can have an elongate shape. The protrusion and sleeve can have sides with flat outer surfaces that merge into respective curved lower ends. The sleeve can have a shape that conforms to the protrusion shape. The sleeve can provide the only contact between the arm and the handle.

With the handle extending upward, the sleeve and protrusion can be below and laterally offset from a pivot attachment centerline of the handle. In position in a circuit breaker, the protrusion and sleeve can rock back and forth in a curvilinear channel of the arm so that one side of the sleeve contacts a first end of the curvilinear channel in the ON position and a second opposing side of the sleeve contacts a second end of the curvilinear channel in the OFF position.

Other embodiments are directed to handle bearing assemblies for a circuit breaker.

The handle bearing configurations can be configured to withstand the UL 489 (standard BR2125) endurance test requirements, e.g., 10,000 repetitions of handle movement through the operative positions, without failure and/or undue degradation.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
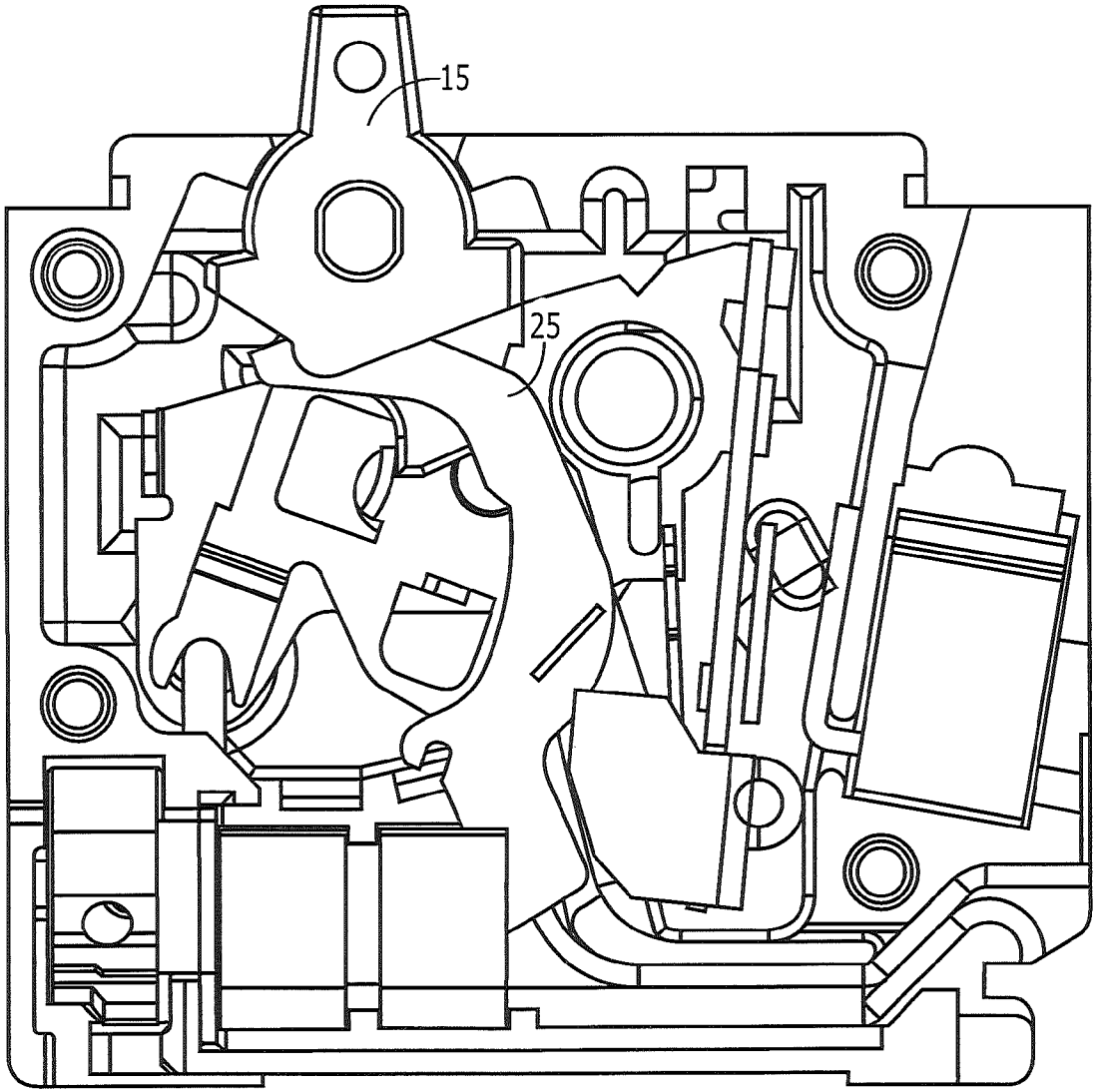
Figure 1 (PRIOR ART)
FIG. 1 is a side partial cutaway view of an exemplary prior art circuit breaker, with the handle and arm in a TRIP configuration.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "self-retaining" with respect to a handle bearing sleeve means that the sleeve engages a handle to lock into a non-rotatable position and requires no other retention component.

The handle can be associated with a disconnect operator (e.g., an operating handle) connected to an assembly for opening and closing separable main contacts in a circuit breaker or for turning power ON and OFF using a switch associated with a fuse. The circuit breaker can be for a motor starter unit or feeder unit, for example.

Turning now to the figures, FIGS. 2A-2C and 3A-3C illustrate an exemplary circuit breaker 10 with a housing 10*h*, handle 15, moveable contact arm 25 and handle bearing sleeve 35 that fits over a handle bearing segment of the handle 18. The handle bearing segment 18 can comprise a protrusion as shown and/or other configurations that allow the handle 15 and arm 25 to move while the handle remains in contact with the arm 25. The sleeve 35 resides against an end portion of the arm 25.

Figure 2A:
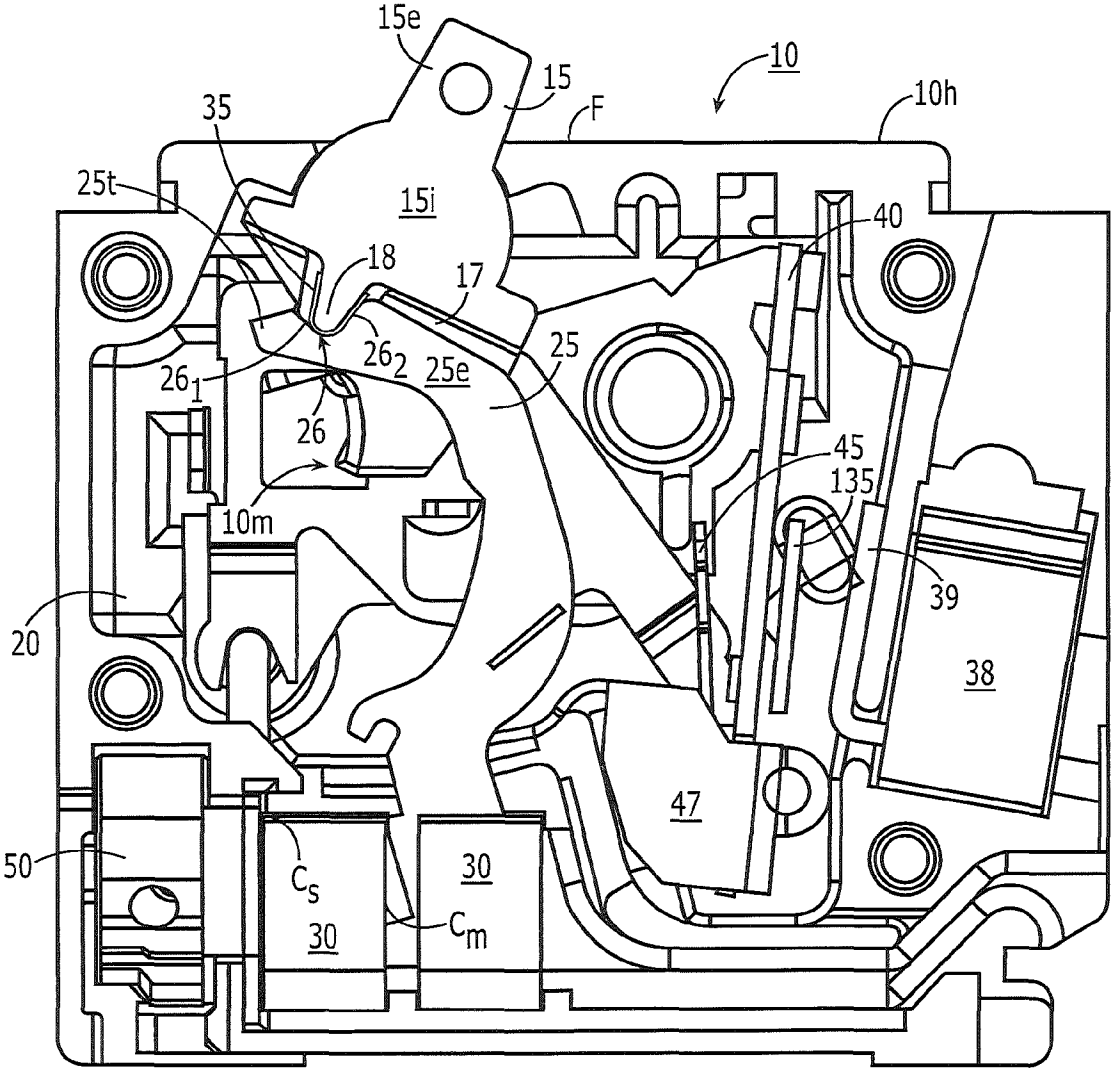
FIG. 2A is a front partial cutaway view of an exemplary circuit breaker with the handle in an exemplary "OFF" position according to embodiments of the present invention.
Figure 2B:
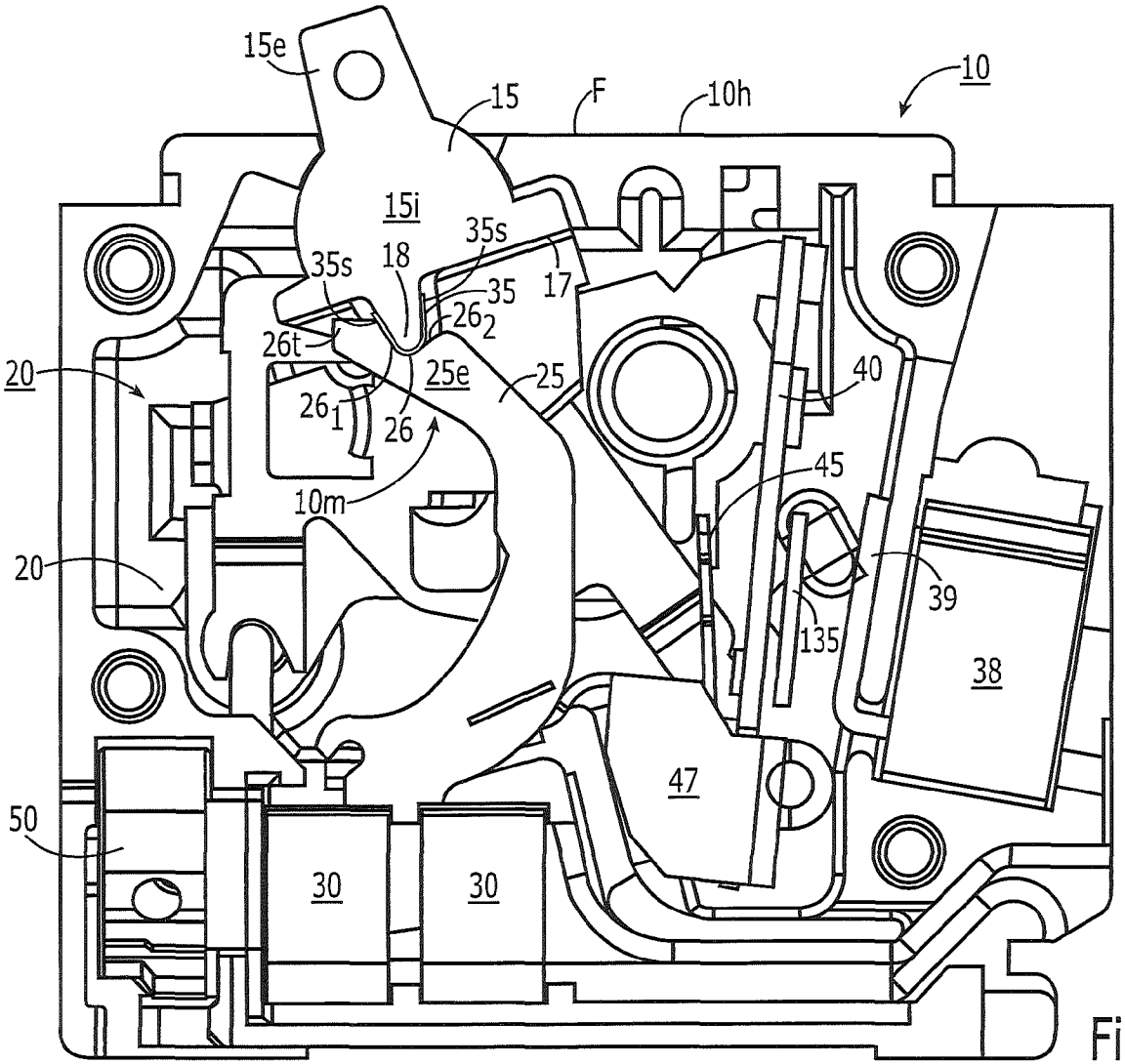
FIG. 2B is a front partial cutaway view of the circuit breaker shown in FIG. 2A illustrating the handle in an "ON" position according to embodiments of the present invention.
Figure 2C:
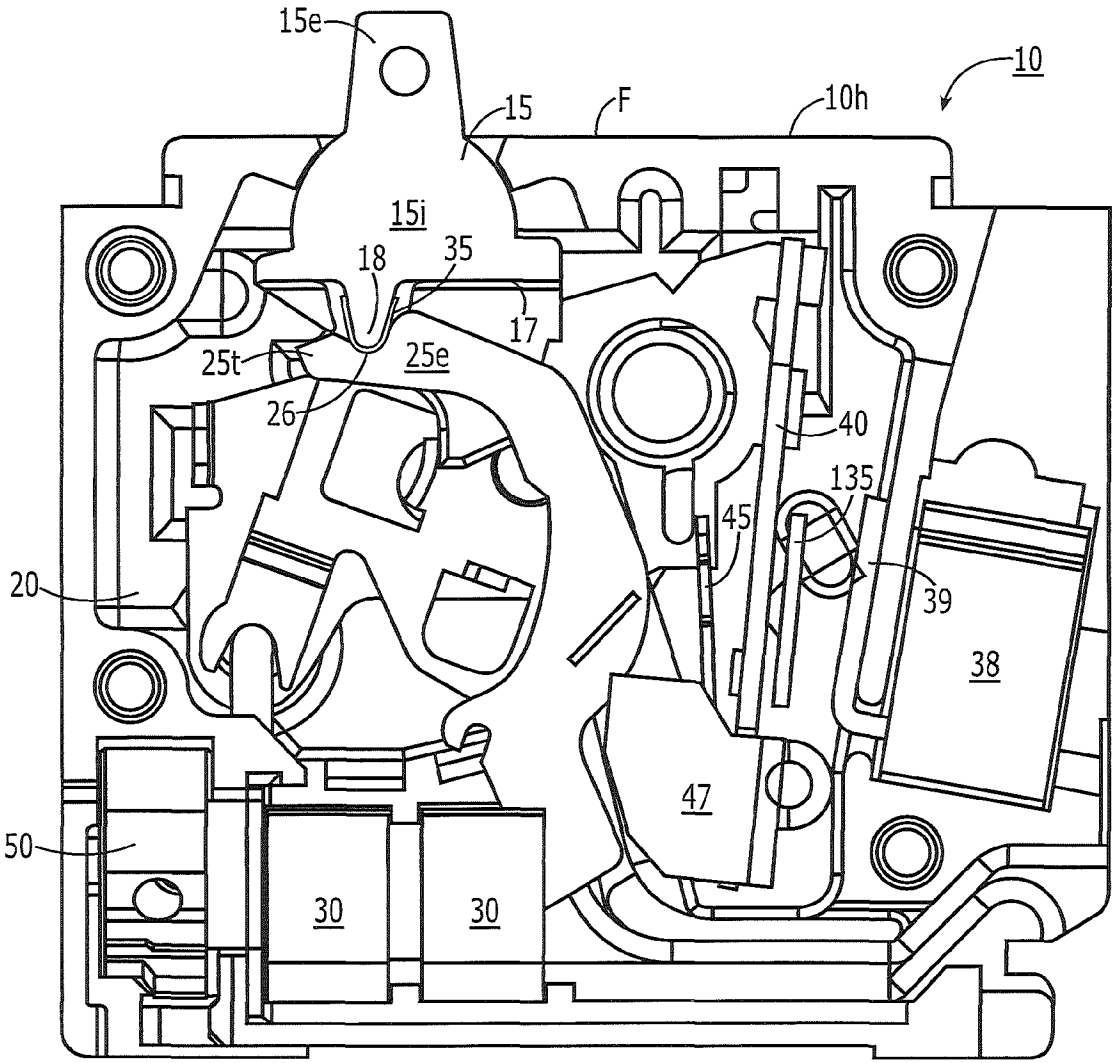
FIG. 2C is a front partial cutaway view of the circuit breaker shown in FIG. 2A illustrating the handle in a "TRIP" position according to embodiments of the present invention.
Figure 3A:
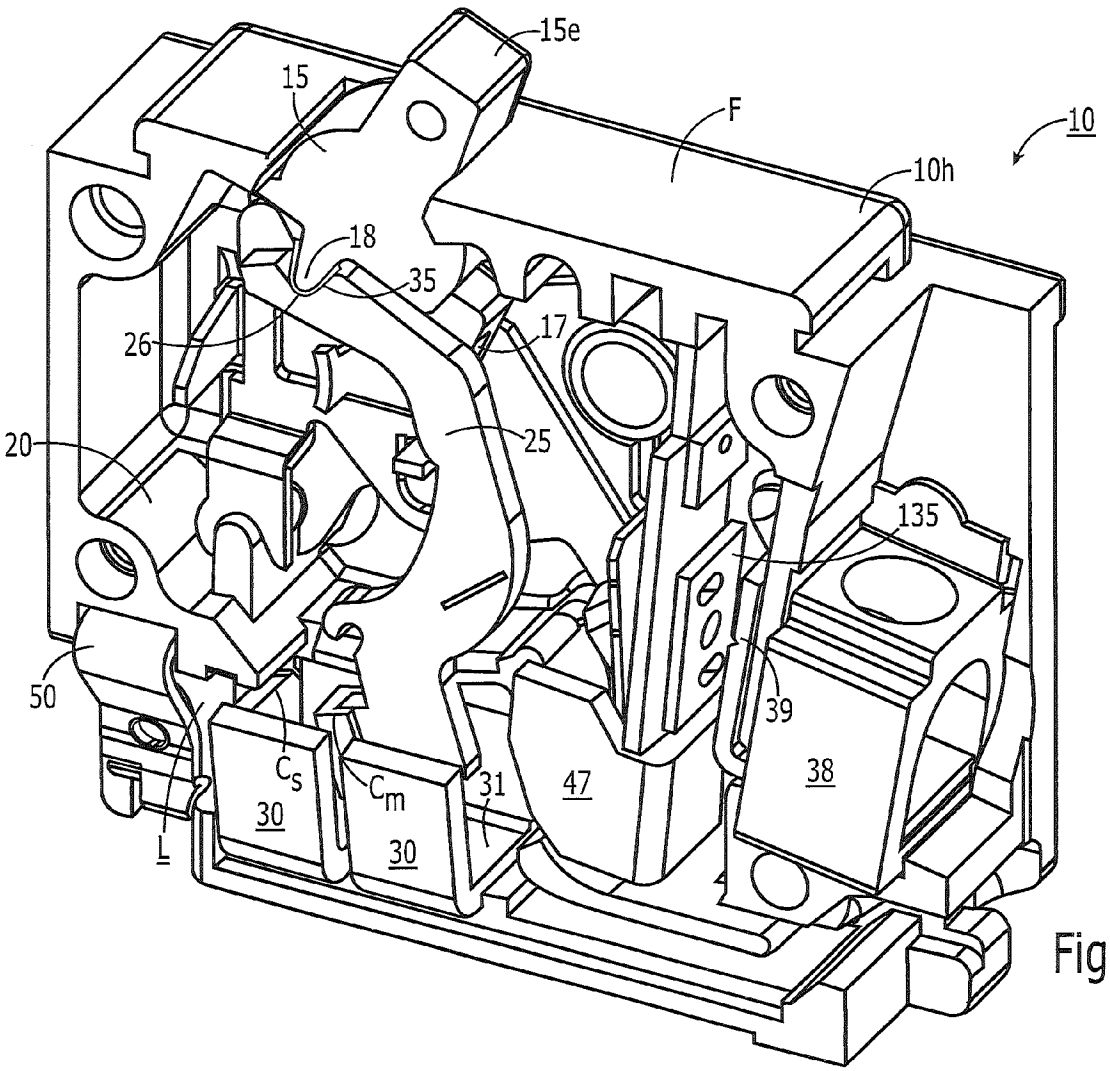
FIG. 3A is a front perspective view of an exemplary circuit breaker with the handle in an exemplary "OFF" position according to embodiments of the present invention.
Figure 3B:
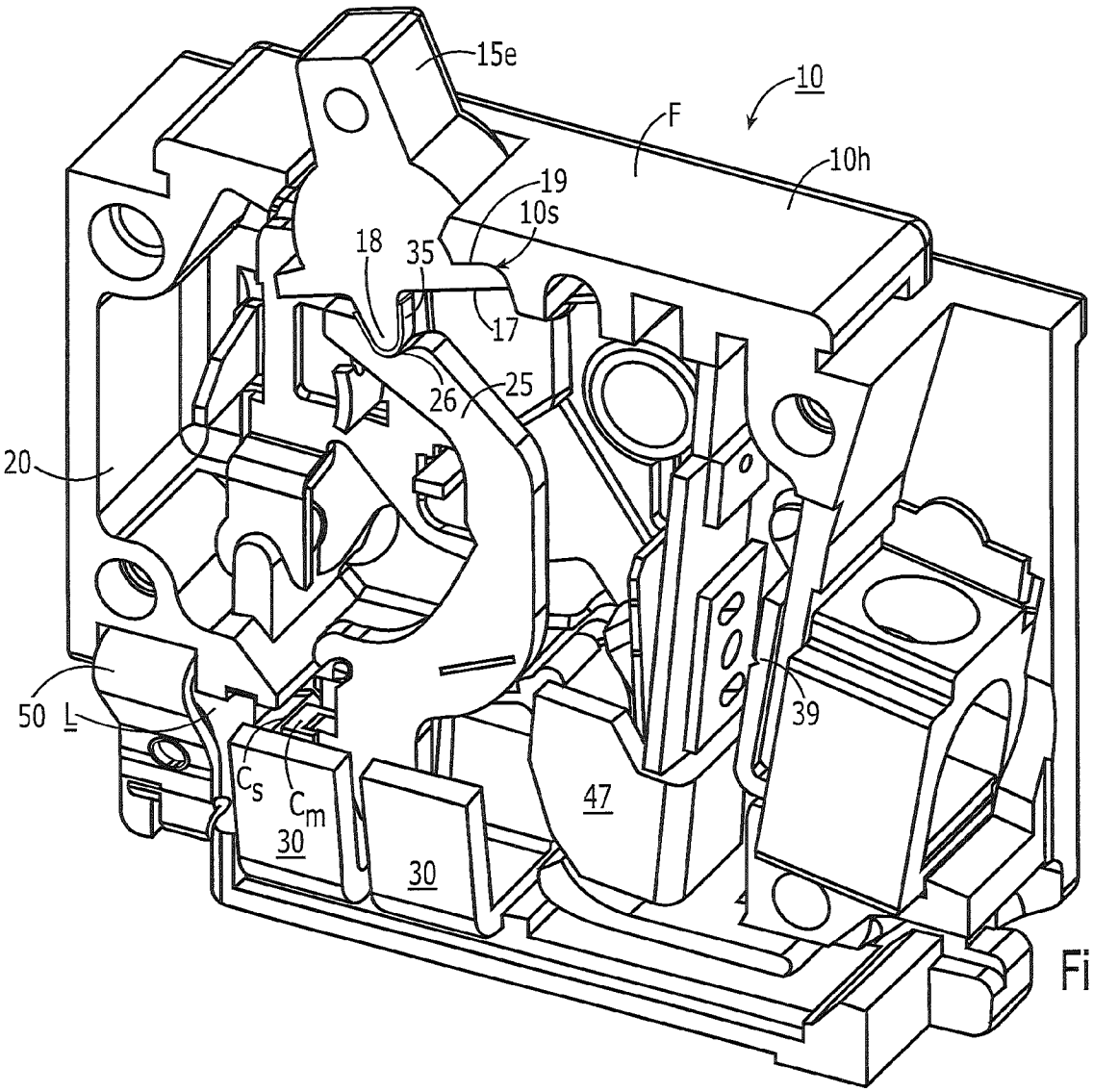
FIG. 3B is a front perspective view of the circuit breaker shown in FIG. 3A illustrating the handle in an "ON" position according to embodiments of the present invention.
Figure 3C:
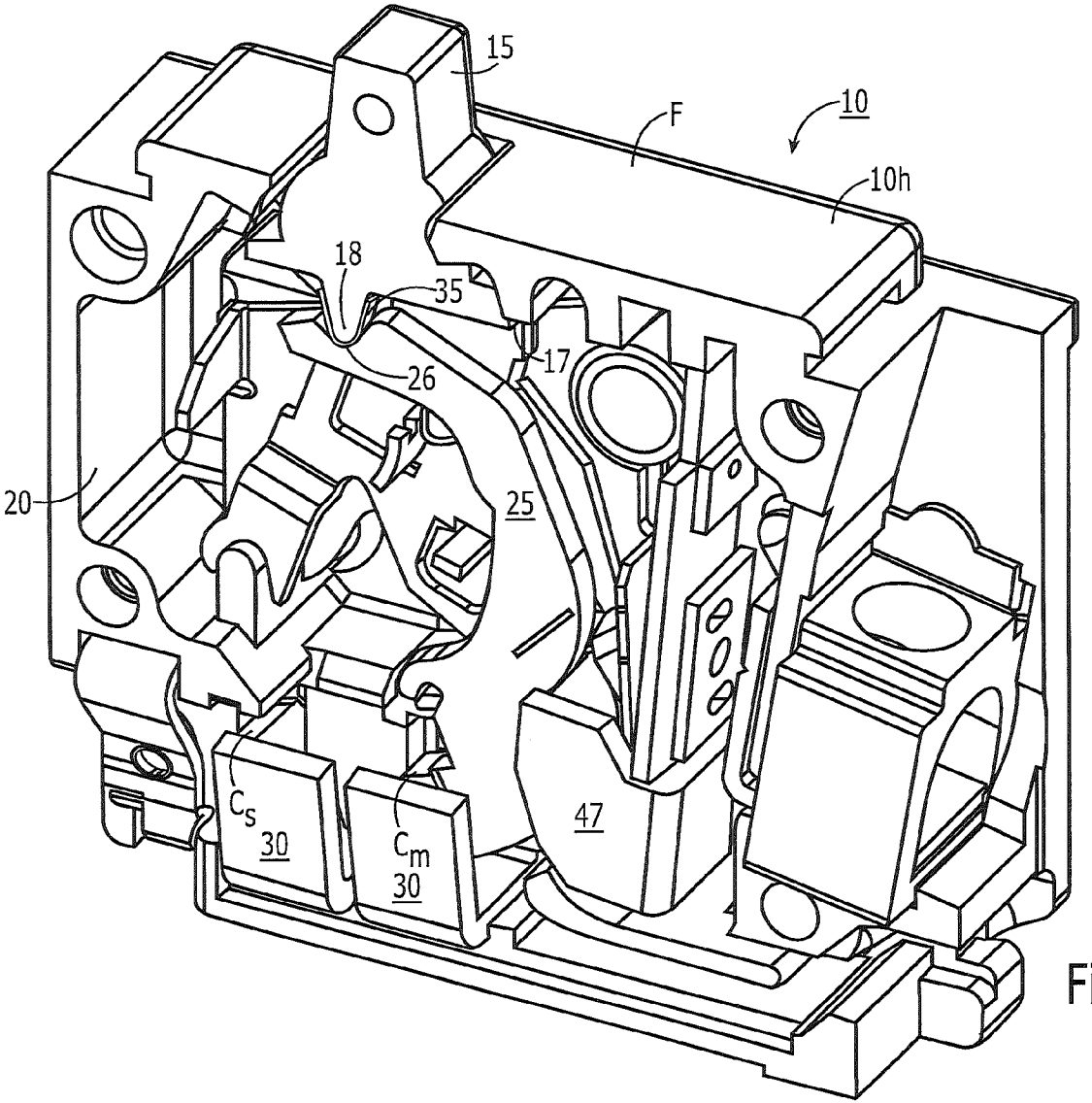
FIG. 3C is a front perspective view of the circuit breaker shown in FIG. 3A illustrating the handle in a "TRIP" position according to embodiments of the present invention.

FIGS. 2A and 3A illustrate an exemplary handle 15 and arm 25 orientation in an OFF position. FIGS. 2B, 3B illustrate an exemplary orientation in an ON position. FIGS. 2C, 3C illustrate an exemplary orientation in a TRIP position.

It is noted that not all circuit breakers 10 require a TRIP position (e.g., fused switches), so in some embodiments, the arm 25 and handle 15 can include only two operative positions, ON, OFF, rather than the noted ON, OFF and TRIP positions.

As shown in FIGS. 2A and 2B, the first end portion of the arm has a curvilinear channel 26 that holds the sleeve 35 and allows the handle bearing segment (e.g., protrusion) 18 and sleeve 35 to rock back and forth in the curvilinear channel 26 so that one side 35*s* of the sleeve contacts a first end of the channel $\mathbf{26}_1$ in the ON position and a second opposing side of the sleeve 35*s* contacts a second end of the channel $\mathbf{26}_2$ in the OFF position, with the end of the sleeve 35 remaining in contact with the channel 26 during movement through the various operative positions.

Typically, the front face F of the housing resides in a vertical orientation.

As is well known, the circuit breaker 10 includes at least one arc chamber 20 having at least one arc chute 30 with arc plates 31 (FIG. 3A), a mechanism assembly 10*m* (FIG. 4) with the arm 25 holding a contact Cm (e.g., a moving contact attached to the "contact arm") and a stationary contact Cs proximate a line terminal L. The arm 25 is conductive, typically non-ferromagnetic metal such as, but not limited to, copper. The arc plates 31 can be stacked and are typically configured as closely spaced plates 31 as shown.

As shown in FIGS. 2A-2C and 3A-3C, the sleeve 35 resides between the handle bearing segment of the handle 18 and a channel 26 formed in the end portion of the arm 25*e* (shown as the upper end in this orientation). In the orientation shown, the handle 15 can be pivotably attached 15*p* to the circuit breaker housing (directly or indirectly) 10*h* at a location above the sleeve 35 so as to be able to pivot/rotate between the operative positions.

The handle 15 can include an external portion 15*e* which can comprise a user actuator or input such as a lever, thumb or finger wheel or other suitable configuration. The handle pivot 15*p* can be attached to the housing directly or indirectly.

The handle bearing segment 18 and sleeve 35 can be tapered so as to have sides 18*s*, 35*s*, respectively, that travel inward to reside closer as the sides move further away from the external part of the handle 15*e*. The sides 18*s*, 35*s* can have planar external surfaces and can be configured so that opposing sides taper in as they travel from top to bottom to reside closer together and merge into a curved tip or end 18*e*, 35*e*, respectively. The sides 18*s*, 35*s* can have a width W that is between about 0.10 inches to about 0.25 inches, typically between about 0.100 inches and about 0.150 inches (and may be held to a relatively tight tolerance of +/−0.002). The sleeve 35*s* sides and end 35*e* have a conformable shape to the shape of the sides 18*s* and tip end 18*e* the handle bearing surface, e.g., the protruding segment 18.

Figure 7:
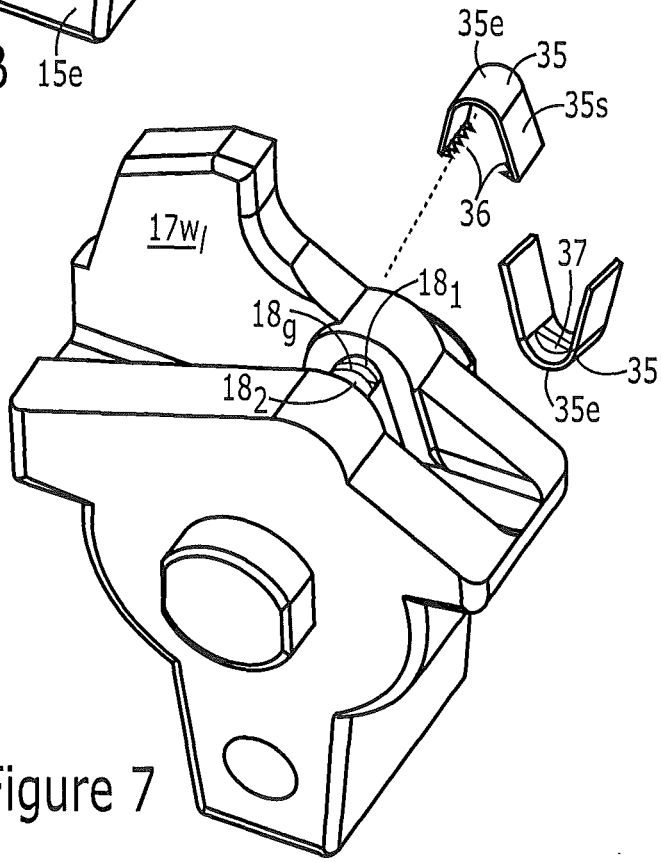
FIG. 7 is an enlarged exploded bottom perspective view similar to that shown in FIG. 6B but with different optional sleeve configurations and/or an optional handle protrusion configuration according to embodiments of the present invention.

The handle bearing segment of the handle 18 can have a solid continuous outer surface or may be provided as a plurality of spaced apart segments, e.g., two adjacent protruding segments $\mathbf{18}_1$, $\mathbf{18}_2$ with a split 18*g* between adjacent portions, for example, that attach to the sleeve 35 (FIG. 7).

The sleeve 35 can be adhesively attached to the handle bearing segment 18. The sleeve 35 may be provided as an over-molded feature on the handle bearing segment (e.g. protrusion) 18. The sleeve 35 may be mechanically attached to the handle bearing segment (e.g., protrusion) 18 via screws, pins, locking or securing features, frictional engagement and the like. Combinations of adhesives, bonding, and mechanical attachment configurations may be used.

In some embodiments, the sleeve 35 can cover at least a major portion, typically between about 50-100% of a height H of the protrusion (FIGS. 5A-5C) so as to provide the only handle to arm contact surface/interface, e.g., a handle bearing sleeve.

The handle 15, including the handle bearing segment 18, can be polymeric. The sleeve 35 can be conductive or non-conductive. The sleeve 35 may comprise a metallic material or other suitable wear-resistant, sufficiently durable material. The sleeve 35 can be metallic and relatively thin, typically between about 0.002 inches to about 0.010 inches, more typically between about 0.003 inches and 0.007 inches, in some embodiments, such as about 0.001 inches, 0.002 inches, 0.003 inches, 0.004 inches, about 0.005 inches, about 0.006 inches, and about 0.007 inches or any value therebetween. The sleeve 35 can have constant thickness over its entire body. The sleeve 35 can be configured to have greater thicknesses at one or more defined regions such as the upper ends, the lower end or sides (not shown).

The curved end 18*e*, 35*e* may have a radius of curvature "r" which is held tightly to that of the handle bearing without a gap so that it matches within a tolerance of +/−0.002 inches so that the sleeve 35 does not move relative to the handle bearing 18, and may, in some embodiments, be about 0.039 inches.

The handle 15 can have an internal portion 15*i* with an arm receiving channel 17 that remains inside the housing 10*h* (6A, 6B) and the handle bearing segment 18 can comprise a protrusion 18 that conformably holds the sleeve 35 and extends across the arm receiving channel 17. The arm receiving channel 17 has a width direction W (FIG. 6B) that corresponds to a width W direction of the arm 25 (FIG. 4) to slidably receive the first (shown as the upper) end portion of the arm 25*e*. The arm-receiving channel 17 extends in a primary lengthwise direction.

Figure 4:
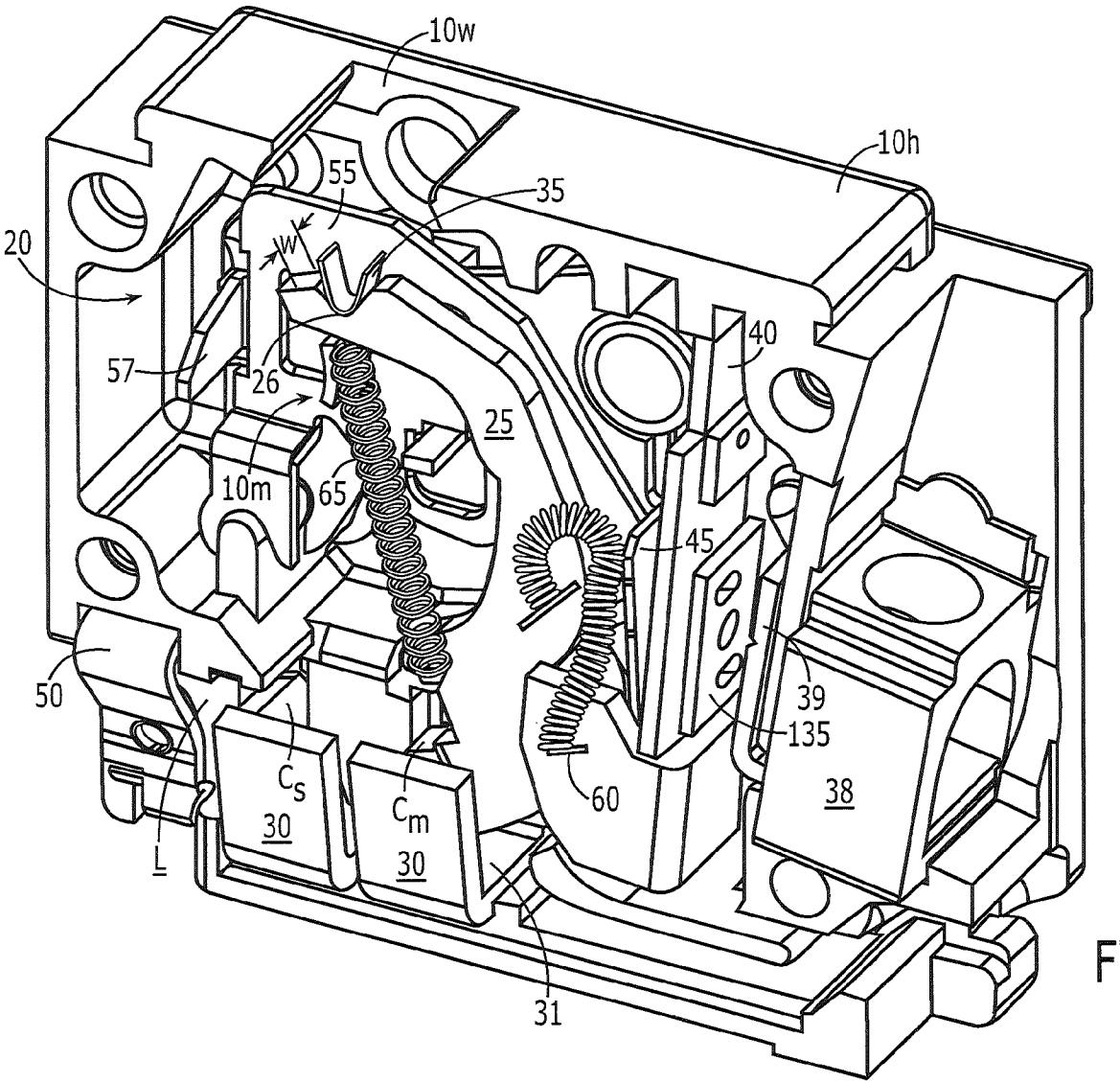
FIG. 4 is a front perspective view of the circuit breaker shown in FIG. 3A illustrated without the handle to show components according to embodiments of the present invention.

FIG. 4 shows the circuit breaker 10 with the handle 15 removed to illustrate a handle window 10*w* in the housing 10*h* and an exemplary configuration of the sleeve 35. In the orientation of the circuit breaker shown, the sleeve 35 is proximate to, but above the arm 25. The sleeve 35 typically contacts the end portion 25*e* of the arm that is opposite the movable contact Cm and provides a bearing surface for the handle/arm interface. The sleeve 35 can reside in the arm channel 26 so as to extend laterally across the end portion of the arm 25*e* in the arm thickness or width W direction. The arm channel 26 can be configured as a depression, well, groove or other channel configuration. The arm channel 26 can be curvilinear. The sleeve 35 can be configured to directly contact the arm channel 26 and remain in contact with the arm channel through the movement of the arm 25 as it pivots or travels between the operative positions. The sleeve 35 can provide the only direct moving contact between the handle 15 and arm 25.

Figure 5A:
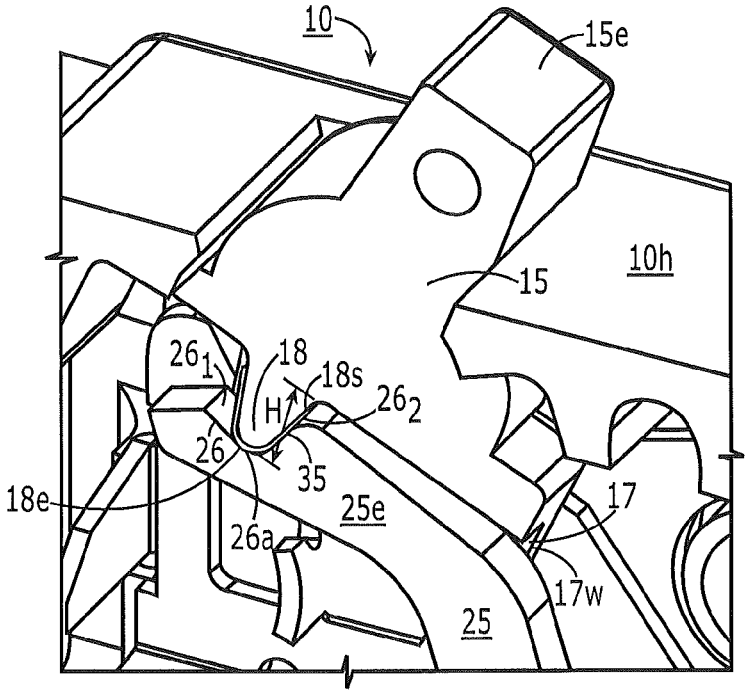
FIGS. 5A-5C are enlarged views of the circuit breaker shown in FIGS. 3A-3C with the handle and arm in respective OFF, ON and TRIP positions according to embodiments of the present invention.
Figure 5B:
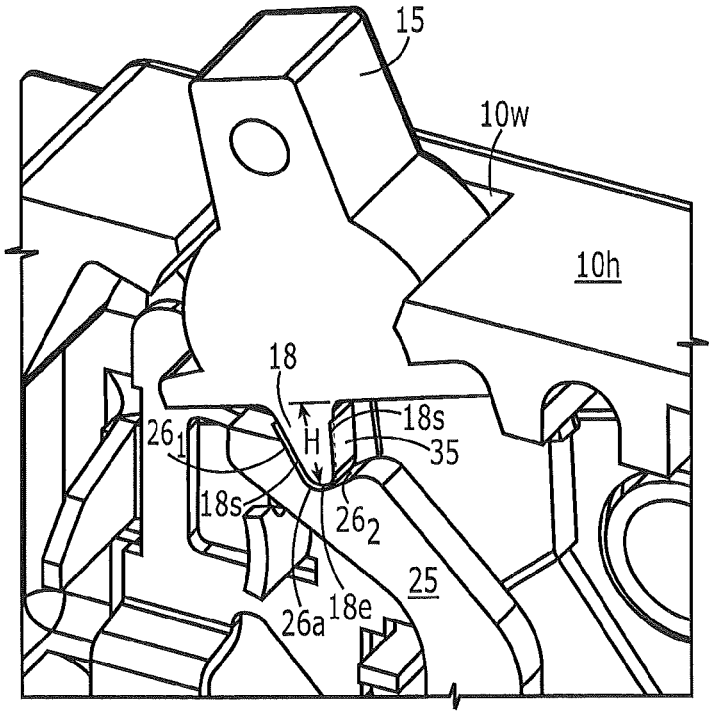
Figure 5C:
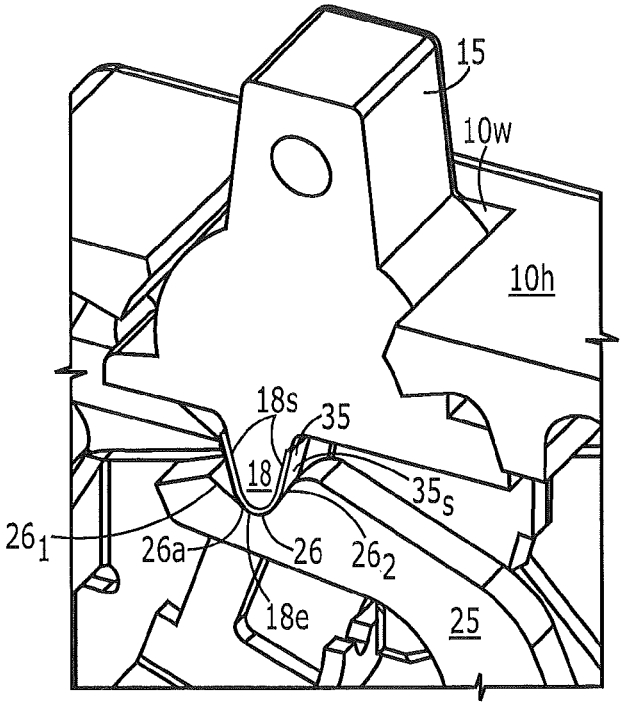

Referring to FIGS. 5A-5C, the channel 26 can have an arcuate medial segment 26*a* between end segments $\mathbf{26}_1$, $\mathbf{26}_2$. The end segments $\mathbf{26}_1$, $\mathbf{26}_2$ can have planar outer surfaces that serially abut (they do not concurrently abut) the respective sides of the sleeve 35*s*.

The channel 26 can have a radius of curvature that corresponds to a radius of curvature of the end of the sleeve 35*e*. The arm channel 26 can be open in a direction facing the pin 18 (shown facing upward) to be able to slidably receive the sleeve 35.

Referring again to FIGS. 2A-2C, 3A-3C and FIG. 4, the circuit breaker 10 can also include one or more of a magnet 135, a load collar 38, a load terminal 39, a bimetal member 40, an armature 45, a shunt bracket 47, a spring clip 50, a cradle 55 and frame 57. The circuit breaker 10 can have alternate configurations and components.

FIG. 4 also schematically illustrates a shunt 60 attached to the arm 25 and shunt bracket 47. The shunt 60 can be resilient and/or flexible. FIG. 4 also schematically illustrates a mechanism spring 65 which is part of the operator mechanism 10*m*, as is well known to those of skill in the art.

A respective circuit breaker 10 can have a plurality of pairs of handles 15 (with sleeves 35) and respective arms 25 as is also well known in the art.

FIGS. 3A-3B illustrate the arm receiving channel 17 can reside between sidewalls 17*w* of a lower portion of the handle 15 that receives the upper end portion of the arm 25.

As discussed above, the handle 15 can have an internal portion 15*i* with the channel 17 (FIGS. 3A, 5A, 6B) to slidably receive the end portion of the arm 25*e*. The sleeve and handle bearing segment 35, 18 can extend across the channel 17 at an inner end portion of the channel 17 thereby allowing the sleeve 35 to form the handle bearing contact surface for the arm 25.

FIGS. 2A-2C, 3A-3C and 5A-5C also illustrate exemplary handle and arm positions for different operative positions, OFF, ON and TRIP. The movements can be over a desired angulation, typically between about 45 degrees to about 90 degrees, more typically about 90 degrees between the OFF and ON positions with the TRIP position between the OFF and ON. In the ON position, the arm 25 places the moveable contact Cm in abutting contact with the stationary contact Cs (FIG. 3B). In the OFF position, the arm 25 rotates to move the moveable contact Cm away from the stationary contact Cs (FIG. 3A). In the TRIP position, the arm 25 also positions the moveable contact Cm away from the stationary contact Cs (FIG. 3C), typically a distance greater than the spaced apart distance of the two contacts Cs, Cm in the "OFF" position. The upper end of the arm 25*e* is able to move relative to the handle 15 in the arm receiving channel 17 of the handle while the protrusion and conformable sleeve 18, 35 remain in the arm channel 26 (FIGS. 4, 5A-5C). Stated differently, the arm channel 26 cooperates with the handle bearing segment (e.g., protrusion) 18 with sleeve 35 so that the handle bearing segment (e.g., protrusion) 18 with sleeve 35 rocks back and forth in the channel 26 as the handle 15 moves through different operative positions. Compare the position of the upper end of the arm 25*e* with the handle channel 17 in FIGS. 3A-3C and 5A-5C, for example.

The handle 15 with the protrusion 18 and sleeve 35 can be provided as a handle bearing assembly/subassembly.

With the circuit breaker oriented with the handle 15 extending upward as shown, the arm 25 can be configured to have an elongate concave shape with the upper end portion 25*e* having a tip end 25*t*. The arm receiving channel 17 can extend across an entire bottom portion of the handle 15*l* and can have a tip end 17*t* (FIG. 6B) that allows the tip end of the arm 25*t* to move relative thereto so as to retract (FIG. 2B) and extend (FIG. 2A) therefrom. The protrusion 18 and sleeve 35 can be held closer to the tip end of the arm receiving channel 17*t* (FIG. 5A-5C) relative to the other opposing end of the channel 17.

Typically, in use, the face F (FIGS. 2A-2C) of the housing/circuit breaker is oriented to be vertical with the handle facing outward.

The circuit breaker 10 can be configured to provide a stop 10*s* proximate the window 10*w* and extending inwardly to contact a handle ledge 19 that extends above the arm channel 17 when the handle 15 is in the ON position (FIG. 3B).

FIGS. 5A and 5B illustrate a greatly enlarged view of an exemplary handle 15 and exemplary protrusion 18 with sleeve 35. The protrusion 18 can reside below the handle pivot 15*p* a distance D1 and can be offset a lateral offset distance D2 from the axially extending centerline of the pivot attachment 15*p* of the handle 15. The distance D1 can be about 0.094 inches and the distance D2 can be about 0.298 inches.

Figure 6A:
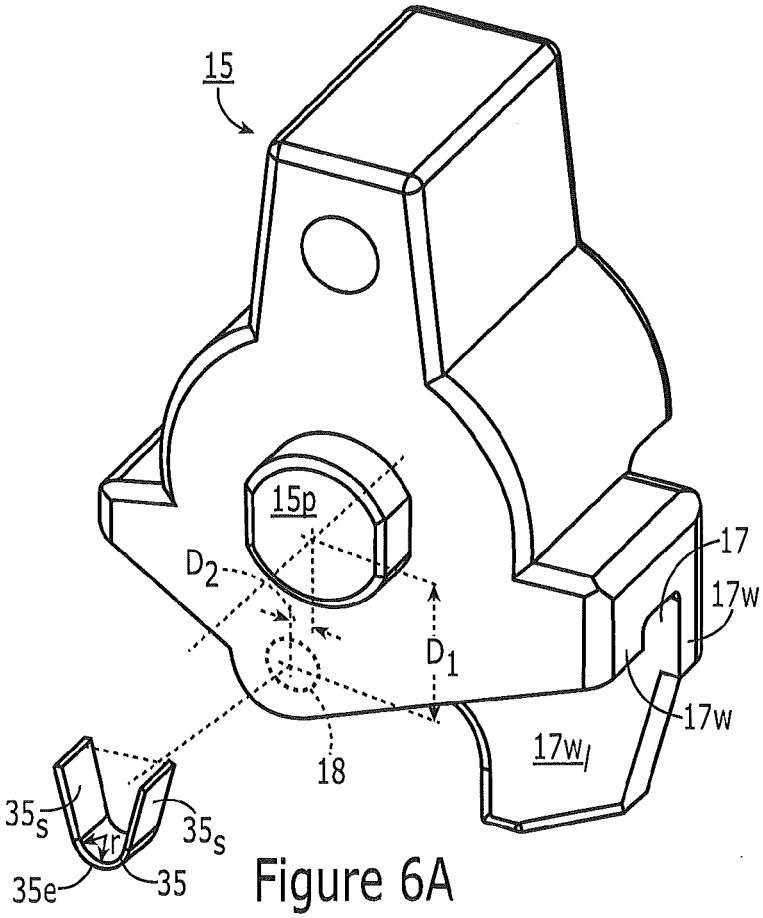
FIG. 6A is an enlarged exploded top perspective view of a handle and sleeve assembly for a circuit breaker according to embodiments of the present invention.
Figure 6B:
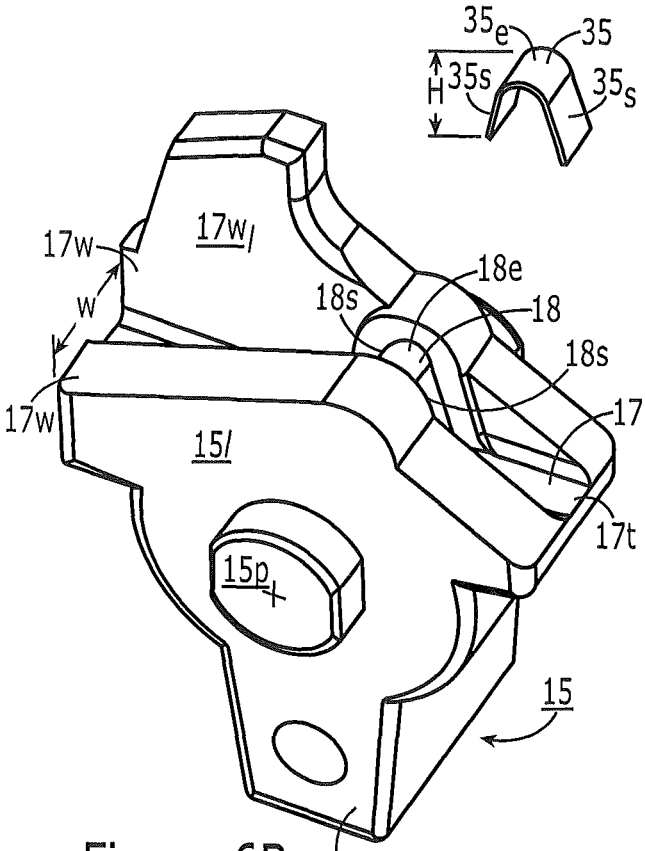
FIG. 6B is an enlarged exploded bottom perspective view (with the handle orientation shown upside down from the view of FIG. 6A) according to embodiments of the present invention.

FIGS. 6A and 6B show an exemplary substantially "V" shape of the sleeve 35, e.g., a "V" or "V"-like shape with a lower rounded end 35*e* rather than a point and with a height H that is between about typically between 0.10 and 0.40 inches, more typically about 0.244 inches.

In some embodiments, the sides of the sleeve 35*s* have a height of between about 0.110 to about 0.150, typically between about 0.117 inches to about 0.137 inches.

FIGS. 2A-2C, 3A-3C, and 5A-5C illustrate the arm 25 with respect to a section view of an exemplary arm receiving channel 17 (one sidewall 17*w* is omitted). FIGS. 6A and 6B illustrate an embodiment with the handle arm channel 17 having a pair of spaced apart sidewalls 17*w*, one of which can be longer than the other, 17*wl*. The longer channel 17*wl* can extend down a distance that is between about 1.5× to about 10 times the length of the shorter sidewall, typically between about 2× to about 5×, such as about 3×.

The arm receiving channel 17 can extend across an entire diameter of a bottom portion of the handle as shown in FIG. 6B.

The handle 15 can be a monolithic molded polymeric member. The handle bearing segment (e.g., protrusion_18 can be an integral part of the handle. The handle bearing segment 18 may alternatively be a separate component that can be attached to the handle 15.

FIG. 7 illustrates that the sleeve 35 can have attachment features 36 and/or 37. For the attachment feature 37 on the end of the sleeve 35*e*, this attachment feature 37 can be an upwardly extending member or members that can enter a gap 18*g* in closely spaced apart segments $\mathbf{18}_1$, $\mathbf{18}_2$ forming the handle bearing segment (e.g., protrusion) 18. Attachment feature 36 can reside on upper ends of the sidewalls 35*s* and extend inwardly toward each other to attach to the protrusion 18. The feature 36 may have serrated edges as shown or may have other shapes such as a straight edge. A respective sleeve 35 may include both attachment features 36, 37 (or none).

The sleeve 35 can have suitable material and can be selected to provide the durability and performance criteria associated with UL 489 endurance testing.

In some embodiments, the circuit breakers 10 can be DC circuit breakers, AC circuit breakers, or both AC and DC circuit breakers.

The circuit breakers 10 can be rated for voltages between about 1 V to about 5000 volts (V) DC and/or may have current ratings from about 15 to about 2,500 Amperes (A). The circuit breakers 10 may be high-rated miniature circuit breakers, e.g., above about 70 A in a compact package. However, it is contemplated that the circuit breakers 10 and components thereof can be used for any voltage, current ranges and are not limited to any particular application as the circuit breakers can be used for a broad range of different uses.

The circuit breakers 10 can be a bi-directional direct current (DC) molded case circuit breaker (MCCB). See, e.g., U.S. Pat. Nos. 5,131,504 and 8,222,983, the contents of which are hereby incorporated by reference as if recited in full herein. The DC MCCBs can be suitable for many uses such as data center, photovoltaic, and electric vehicle applications.

As is known to those of skill in the art, Eaton Corporation has introduced a line of molded case circuit breakers (MCCBs) designed for commercial and utility scale photovoltaic (PV) systems. Used in solar combiner and inverter applications, Eaton PVGard™ circuit breakers are rated up to 600 amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating. In some particular embodiments, the circuit breaker 10 can be a high-rating miniature circuit breaker.

The circuit breaker 10 may be particularly suitable for the BR circuit breakers with a thermal-magnetic trip curve that avoids nuisance tripping on mild overloads while reacting almost instantaneously to severe short-circuit conditions, such as the BRX circuit breaker from Eaton Corporation, Cleveland, Ohio.

The handle bearing configuration provided by the sleeve 35 can remove a plastic wear point of the prior art configuration and reduce wear, eliminate or reduce wear and heat (friction induced) relative to the design shown in FIG. 1. The sleeve 35 may have detectable wear of only about 0.001 inches after endurance testing carried out under UL 489 (BR2125) for about 10,000 operations.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker comprising:

a housing;

a pivotable handle held by the housing, the handle having an inwardly extending handle bearing segment;

a sleeve held on the handle bearing segment; and a moveable contact arm held in the housing, the arm having opposing first and second end portions, the first end portion of the arm moves against the sleeve as the arm and handle move between ON and OFF positions in the housing and the second end portion has the moveable contact.

2. The circuit breaker of claim 1, further comprising a stationary electrical contact held in the housing so as to selectively electrically engage the movable contact, wherein the first end portion of the arm is held in an arm receiving channel in the handle.

3. The circuit breaker of claim 1, wherein the circuit breaker has a TRIP operative position, and wherein the first end portion of the arm moves against the sleeve as the arm and handle move between the ON and OFF positions and the TRIP position.

4. The circuit breaker of claim 1, wherein the handle bearing segment has an elongate shape, and wherein the sleeve has a shape that conforms to the elongate shape, and wherein the sleeve provides the only direct moving contact between the arm and the handle.

5. The circuit breaker of claim 1, wherein the first end portion of the arm moves back and forth under the sleeve while in continuous abutting contact with the sleeve.

6. The circuit breaker of claim 1, wherein the handle bearing segment comprises a protrusion and the sleeve and protrusion have sides with flat outer surfaces that merge into respective curved lower ends.

7. The circuit breaker of claim 6, wherein the sleeve and handle bearing segment with the sleeve are below and laterally offset from the pivot attachment axis of the handle.

8. The circuit breaker of claim 1, wherein the first end portion of the arm has a curvilinear channel that holds the sleeve and allows the handle bearing segment with the sleeve to rock back and forth in the curvilinear channel so that one side of the sleeve contacts a first end of the curvilinear channel in the ON position and a second opposing side of the sleeve contacts a second end of the curvilinear channel in the OFF position.

9. The circuit breaker of claim 1, wherein the first end portion of the arm has an upwardly facing channel that holds the sleeve, and wherein the upwardly facing channel has an arcuate medial segment between planar end segments.

10. The circuit breaker of claim 2, wherein the handle bearing segment comprises a protrusion that conformably holds the sleeve and which extends across the arm receiving channel.

11. The circuit breaker of claim 1, wherein the sleeve is metal, has a thickness of between about 0.001 to about 0.010 inches, and has a "V" like shape with the sides tapering inward to a rounded end.

12. The circuit breaker of claim 1, wherein the sleeve has a thickness of about 0.003 inches.

13. The circuit breaker of claim 1, wherein the sides of the sleeve have a height of between about 0.115 inches to about 0.137 inches.

14. A handle bearing assembly for a circuit breaker, comprising:

a pivotable handle for a circuit breaker configured to rotate between ON and OFF positions, the handle having a lower portion comprising an arm receiving channel and at least one handle bearing segment with a sleeve covering the handle bearing segment, wherein the handle bearing segment with the sleeve extends across the arm receiving channel, and wherein the sleeve is configured to contact an arm providing a movable contact for the circuit breaker.

15. The handle bearing assembly of claim 14, wherein the arm receiving channel extends across an entire bottom portion of the handle and has an open tip end configured to allow a tip end of the arm to retract and extend therefrom.

16. The handle bearing assembly of claim 14, wherein the sleeve is metal, has a thickness of between about 0.001 to about 0.010 inches, has a "V" like shape with the sides tapering inward to a rounded end, with planar surfaces that contact the arm receiving channel.

17. The handle bearing assembly of claim 14, wherein the sleeve has a thickness of about 0.003 inches.

18. The handle bearing assembly of claim 16, wherein the sides of the sleeve have a height of between about 0.117 inches to about 0.137 inches.

19. The handle bearing assembly of claim 14, wherein the handle bearing segment comprises a protrusion with an elongate shape, wherein the protrusion and sleeve have sides with flat outer surfaces that merge into respective curved lower ends, wherein the sleeve has a shape that conforms to the protrusion shape, and wherein the sleeve provides the only moving contact between the arm and the handle.

20. The handle bearing assembly of claim 19, wherein the sleeve and protrusion are laterally offset from a pivot axis of the handle, and wherein, in position in a circuit breaker, the protrusion and sleeve rock back and forth in a curvilinear channel of the arm so that one side of the sleeve contacts a first end of the curvilinear channel in the ON position and a second opposing side of the sleeve contacts a second end of the curvilinear channel in the OFF position.

* * * * *